United States Patent [19]

Wright

[11] 4,141,335

[45] Feb. 27, 1979

[54] DUAL MODE FURNACE

[76] Inventor: Otis L. Wright, 9511 Telstar Dr., Richmond, Va. 23234

[21] Appl. No.: 826,910

[22] Filed: Aug. 22, 1977

[51] Int. Cl.[2] ..... F24H 3/10

[52] U.S. Cl. ..... 126/111; 126/67

[58] Field of Search ..... 126/111, 116 R, 121, 126/61, 63, 66, 67

[56] References Cited

U.S. PATENT DOCUMENTS

| | | | |
|---|---|---|---|
| 660,371 | 10/1900 | Foley | 126/67 |
| 1,590,379 | 6/1926 | Kaiser | 126/116 R |
| 2,471,351 | 5/1949 | Russell | 126/116 R X |
| 2,578,927 | 12/1951 | Esson | 126/111 |
| 3,977,601 | 8/1976 | Bearzi | 237/1 A |
| 3,981,291 | 9/1976 | Smith | 126/116 R X |

*Primary Examiner*—William E. Wayner
*Assistant Examiner*—William E. Tapolcai, Jr.
*Attorney, Agent, or Firm*—Norman B. Rainer

[57] ABSTRACT

A furnace is provided which is capable of heating a circulating current of air by heat produced from the combustion of either solid or fluid fuel. The furnace is constructed with two separate combustion compartments and an intervening chamber for circulation of the air to be heated. By means of temperature sensor and control means, the fluid fuel supply is stopped when adequate heat is being produced from the solid fuel. The furnace is adapted to heat remotely located rooms by means of conduits which transport said heated air. The room in which the furnace is located is heated by radiation and convectively heated contiguous air.

9 Claims, 3 Drawing Figures

DUAL MODE FURNACE

BACKGROUND OF THE INVENTION

This invention relates to an improved furnace useful for heating a building, and is more particularly concerned with a furnace capable of burning both fluid or solid fuels for the purpose of heating air which is circulated to the rooms of a building.

Many residential dwellings are equipped with fireplaces designed for the burning of wood in the form of logs. In such fireplaces, the fire creates an upward draft causing considerable amounts of air to be taken from the building and transported up the flue or chimney and out of the building. The only heat provided by the burning wood is of a radiative nature, and it generally does not compensate for the amount of heat removed from the building in the form of air exhausted through the chimney. Also, whereas the radiative heat will generally affect only the room in which the fireplace is located, the removal of air from the building will cause other rooms to become colder because of the influx of colder air from outside the building. Most such fireplaces are in effect intended primarily as decor, particularly to many who find the burning of logs to be an aethetically pleasing sight.

For actual heating purposes, most residential homes are equipped with specially designed furnaces wherein a liquid fuel such as gas or oil may be continuously and controllably fed to a burner wherein it heats the walls of a combustion chamber. Heat is transferred from the hot outer walls of the chamber to a circulating stream of air which is conducted to the various rooms of the building.

There are numerous desclosures of improved fireplaces wherein heat generated from the burning of wood or coal is caused to heat walls of a chamber which transfers the heat to a circulating stream of air in a manner similar to that employed with oil and gas operated furnaces. Specific examples of such systems may be found in the following U.S. Pat. Nos. 234,921; 695,840; 1,656,326; 2,154,939; 1,505,407; 2,453,954; 2,791,213; 2,172,356; 2,283,790 and 3,981,292.

Although fireplace structures are known having the capability of burning fluid fuels such as gas in addition to wooden logs, the efficiency of utilization of such fluid fuels is generally poor because the combustion compartment is designed primarily to accommodate logs. Also, there is no provision for the concerted utilization of two different fuels to provide a continuous and controllable amount of heat.

It is accordingly an object of the present invention to provide a furnace capable of efficiently utilizing either solid or fluid fuel. It is another object of the invention to provide a furnace capable of efficiently utilizing either solid or fluid fuel to effect the heating of a stream of air which may be circulated to rooms of a building other than the one containing said furnace. It is a still further object of the present invention to provide a fireplace furnace capable of utilizing either a solid or fluid fuel in a manner to provide a continuous and controllable amount of heat. These objects and other objects and advantages of the invention will be apparent from the following description.

SUMMARY OF THE INVENTION

The objects of the present invention are accomplished in general by providing a fireplace structure having a compartment for the combustion of a solid fuel, a compartment for the combustion of a fluid fuel, and a chamber interposed between said combustion compartments through which air can be circulated in a manner to absorb heat from either or both of said compartments. Each of said combustion compartments is constructed at least in part of a thermally conductive material such as iron, and is provided with an opening at the uppermost portion thereof for the escape of combustion fumes, and suitable means for admission of adequate air to support combustion. The compartment for solid fuel combustion is positioned generally above said air circulation chamber which in turn is generally positioned above said compartment for fluid fuel combustion. The air circulation chamber is provided with inlet and outlet openings which may connect with suitable conduits to facilitate passage of air through said chamber.

The exterior surfaces of the walls of said combustion compartments constitute a significant portion of the enclosing boundary of the air circulation chamber. Baffles located within said chamber modify the flow characteristics of the air so as to achieve improved heat transfer from the walls of said combustion compartments.

The front of the furnace is provided with a door which constitutes the front face of the compartment for solid fuel combustion and permits entrance of solid fuel and removal of ashes. Said door contains an adjustable opening to admit the aforesaid controlled amount of air for the combustion of the solid fuel. The upper portion off the compartment for solid fuel combustion is comprised of a rectangular metal panel hinged at its upper edge and angled in a manner such that said hinged upper edge is displaced toward the rear of said furnace.

A stationary rectangular deflector plate is attached at its lower edge to the front of the furnace at a location above the upper edge of said hinged panel, and extends forwardly at an angle generally inverse to the angle of inclination of said hinged panel.

The front, rear, sides and bottom of said furnace are preferably fabricated of flat plate metal, and are joined together to form an integral box-like structure having substantially vertical sides, rear and front, and a substantially horizontally disposed bottom.

BRIEF DESCRIPTION OF THE DRAWINGS

In the accompanying drawing forming a part of this specification and in which similar numerals of reference indicate corresponding parts in all the figures of the drawing.

DETAILED DESCRIPTION OF THE INVENTION

Figure 1:
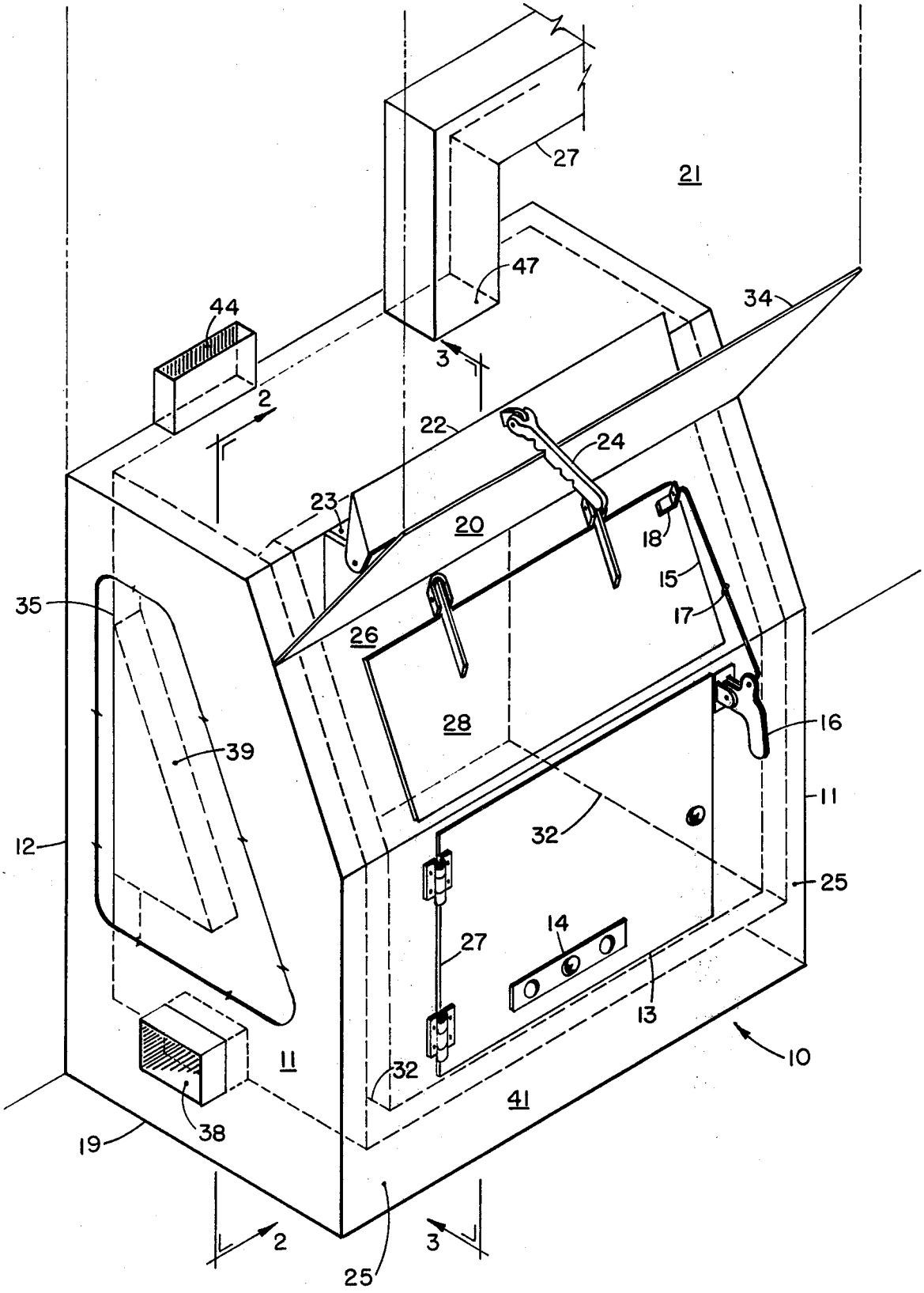
FIG. 1 is a front perspective view of an embodiment of the furnace of the present invention, partially cut away to reveal internal structure.

Referring to FIG. 1, a dual mode furnace 10 of the present invention is shown constructed throughout of heavy gauge iron plates interconnected by welding. The furnace has a substantially box-like general configuration having two sidewalls 11, floor member 19, rear wall 12, front vertical face 25, and front inclined face 26. Both side walls 11 are substantially identical integral members whose edges join at essentially right angles with the other structural surfaces defining the exterior of the furnace.

A door 13 is hingedly attached at one end 27 to front vertical face 25 and adapted to swing horizontally about said hinged end. The door 13 serves to permit access to log burning compartment 28 for insertion of logs or removal of ashes. The door 13, which also serves to retain heat within said compartment, may be fabricated of metal or heat-resistant glass. Associated with door 13 is air entry control 14 adapted to slide from side to side to controllably occlude underlying holes in door 13. The function of air entry control 14 is to admit a sufficient amount of air to the lower portion of log burning compartment 28 to support combustion of logs therein.

An inclined panel 15 is hingedly mounted at its upper edge to front inclined face 26 and adapted to swing vertically about said hinged upper edge. By means of lever 16 and tie rod 17 which engages upright post 18, inclined panel 15 can be raised and locked in an upwardly angled position. The size of panel 15 is somewhat larger than the opening in inclined front face 26 so that, in the downward position, panel 15 is supported by abutting contact with said front inclined face. Panel 15 is adapted to cause a portion of the heat generated within log burning compartment 28 to be transferred into the room containing the furnace by radiation and by convective heating of air outside the furnace and contiguous thereto. The panel also permits access to said log burning compartment.

External deflector plate 20, angled forwardly and upwardly, has appropriate size, shape and position to close the chimney space 21 above the furnace. Said deflector plate further serves to deflect into the room containing the furnace, air which has been convectively heated by panel 15. The forward edge 34 of deflector plate 20 is preferably positioned a distance rearward from the plane of front vertical face 25.

Damper flap 22, operated by notched handle 24, is adapted to control the extent of occlusion of elongated slot 23 in the upper portion of log burning compartment 28. The notches of handle 24 engage with the forward edge 34 of deflector plate 20. By suitable positioning of damper flap 22, the flow of combustion fumes out of log burning compartment 28 may be controllably adjusted.

Figure 2:
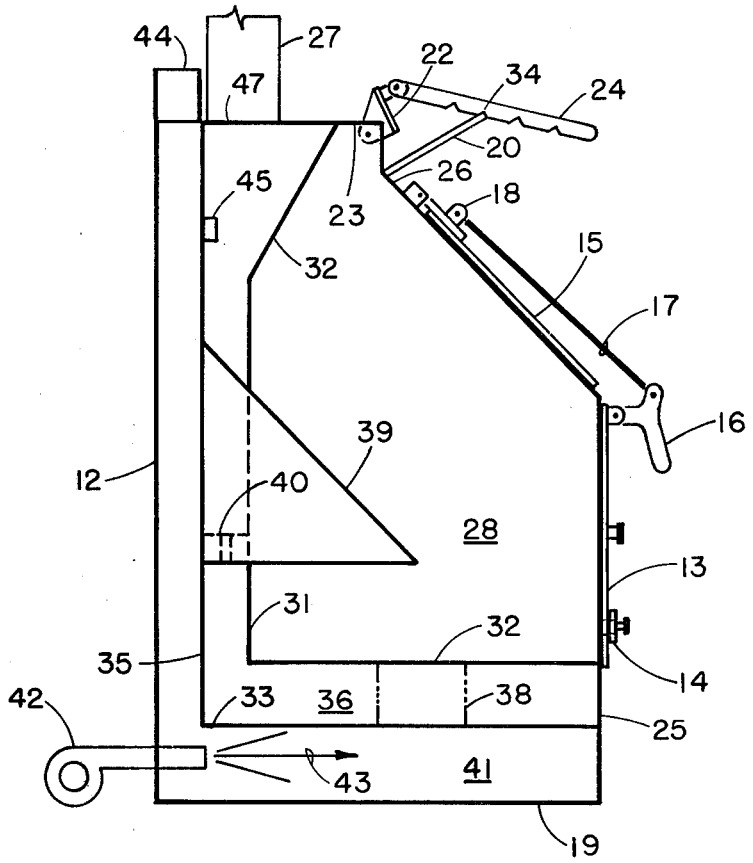
FIG. 2 is a transverse sectional view taken along the line 2—2 of FIG. 1.
Figure 3:
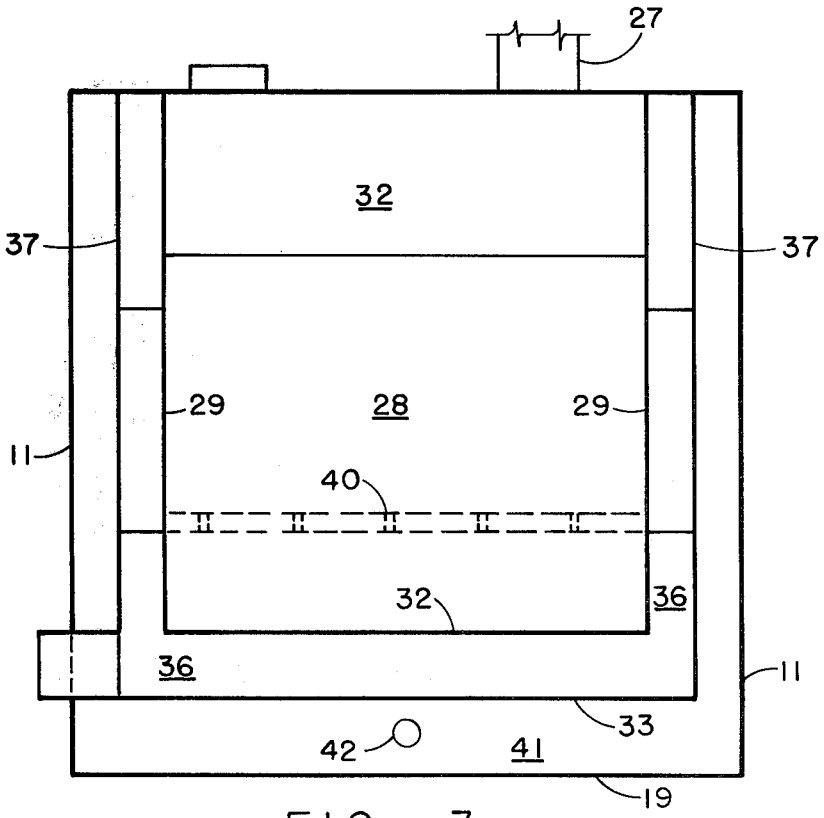
FIG. 3 is a transverse sectional view taken along the line 3—3 of FIG. 1.

As shown in FIGS. 2 and 3, the log burning compartment is bounded at its sides by recessed side walls 29, at its rear by internal rear wall 31, and at its bottom by raised floor 32, said boundary surfaces being interconnected in perpendicular, box-like manner. Most of the top of said log burning compartment is bounded by panel 15, and its front is bounded by door 13. The front vertical edges of recessed side walls 29 are joined to front vertical face 25, and the upper edges of said recessed side walls are joined to front inclined face 26. In this manner, the log burning compartment is essentially suspended above the floor of said furnace. An upper portion of said log burning compartment, at a site above the hinged edge of panel 15, communicates with elongated slot 23. The upper portion 32 of internal rear wall 31 may be angled toward the front of the furnace, as shown in FIG. 2, in order to provide a more streamlined path whereby combustion smoke may exit through slot 23.

The air circulating chamber 36 is bounded from below by horizontal divider 33 which attaches at its front edge to front vertical face 25, and its rear edge to vertical divider 35. The side extremities of chamber 36 are bounded by intermediate side walls 37 whose perimeters are defined by front vertical face 25, front inclined face 26, vertical divider 35, and horizontal divider 33. The upper boundaries of chamber 36 are essentially the outer walls of log combustion compartment 28 which is thereby enveloped at the rear, bottom and both sides by chamber 36. The upper extremity of chamber 36 has an exit opening 47 which communicates with air conduit 27. Air inlet means 38 is provided preferably at a location between the horizontal divider 33, and raised floor 32 of said log burning compartment. Although said air inlet is exemplified in the drawing as being positioned in sidewall 11, it may also be located in front vertical face 25.

Within chamber 36 various baffle or flow control devices may be utilized to cause turbulent flow of air in its passage through said chamber, or in other ways to maximize the efficiency of contact of said air with the various heated surfaces bounding said chamber. Suitable baffles may consist of a pair of wedge shaped deflectors 39, symmetrically positioned on each side of compartment 28 and adjacent vertical divider 35. Diffuser plate 40, extending horizontally between vertical divider 35 and internal rear wall 31, is provided with a series of holes of a size permitting controlled flow of air.

Fluid fuel combustion compartment 41 is bounded on its external periphery by floor member 19, side walls 11, front vertical face 25, and rear wall 12. Its internal periphery is bounded essentially by the outer contour of chamber 36 which is thereby enveloped in part by compartment 41. A fuel injection apparatus such as an oil burner 42 enters the rear portion of said compartment 41 through rear wall 12 and below horizontal divider 33. The fuel is caused to burn in an elongated burner 43 which may provide a single or multiple flames. The purpose of the elongated burner is to distribute the heat of the combusted fuel evenly along horizontal divider 33. An opening 44 is provided in the top of compartment 41 for the purpose of exhausting combustion fumes into chimney 21. Compartment 41 may also be provided with baffles and air deflector devices to control the distribution of heat generated within said compartment.

All exterior surfaces of the furnace, with the exception of panel 15 may be provided with a layer of insulation to minimize heat loss. The exterior of the furnace, with the exception of the door 13 and panel 15 may also be enclosed in brickwork for enhanced aesthetic appearance.

In operation, air to be heated enters the furnace at inlet 38, and emerges from exit opening 47. The air is preferably driven by a fan or blower mechanism, although convective cycling of the air can occur. In instances where electrical power for operating a fan or blower is unavailable or temporarily discontinued, the air to be heated may circulate by said convective means or by manual operation of said fan or blower.

A thermostatic sensor and control means 45 is located in the upper region of chamber 36 and electrically connected to the fluid fuel burner 42 and blower, not shown. The electrical control logic is designed so that, when the temperature exceeds a preset value, the blower will be activated and the burner 42 will be turned off. The control logic reactivates the fluid fuel burner when the temperature produced by heat generated from the log combustion compartment falls a preset level. In this manner, the furnace permits use of discontinuously added wood and/or coal while maintaining a constant rate of total heat output.

Although the log combustion compartment has been illustrated in the drawings as having a flat bottom and straight sides, other configurations may be employed, such as for example an embodiment wherein the end portions of raised floor 32 may have upraised shoulders serving to support logs.

Various expedients known to the art may be employed to further enhance the conduction of heat out of either combustion compartment and into the air circulating chamber.

While particular examples of the present invention have been shown and described, it is apparent that changes and modifications may be made herein without departing from the invention in its broadest aspects. The aim of the appended claims, therefore, is to cover all such changes and modifications as fall within the true spirit and scope of the invention.

What is claimed is:

1. A furnace comprising a first compartment for the combustion of a solid fuel, a second compartment for the combustion of a fluid fuel, a chamber interposed between said compartments through which air can be circulated in a manner to absorb heat from the walls of said compartments, each of said compartments being constructed at least in part of a thermally conductive material and provided with openings for escape of combustion fumes and admission of air to support combustion, and baffles positioned within said chamber for modifying the flow characteristics of air passing therethrough to achieve improved transfer of heat from the walls of said compartments, the bottom of said first compartment being positioned generally above said chamber which is generally positioned above said second compartment.

2. The furnace of claim 1 provided with temperature sensor and control means adapted to stop the fluid fuel supply when heat is being produced in said first compartment.

3. The furnace of claim 1 wherein said chamber is provided with an inlet opening for the admission of air and an exit opening located above said inlet opening.

4. The furnace of claim 3 wherein said baffles comprise a pair of wedge shaped deflectors symmetrically positioned on each side of said chamber spanning the space between opposed vertical walls of said first and second compartments, and adapted to deflect air passing within said chamber between said inlet and exit openings.

5. The furnace of claim 3 wherein said chamber is provided with a horizontally disposed substantially rectangular diffuser located in an ascending region of said chamber and spanning the space between opposed vertical walls of said first and second compartments.

6. A furnace comprising a first compartment for the combustion of a solid fuel, a second compartment for the combustion of a fluid fuel, a chamber interposed between said compartments through which air can be circulated in a manner to absorb heat from the walls of said compartments, each of said compartments being constructed at least in part of a thermally conductive material and provided with openings for escape of combustion fumes and admission of air to support combustion, baffles positioned within said chamber for modifying the flow characteristics of air passing therethrough to achieve improved transfer of heat from the walls of said compartments, and a rectangular metal panel hinged at its upper edge to the front of said first compartment and angled in a manner such that said hinged upper edge is displaced toward the rear of said furnace, the bottom of said first compartment being positioned generally above said chamber which is generally positioned above said second compartment.

7. The furnace of claim 6 wherein a stationary rectangular deflector plate is attached at its lower edge to the front of said furnace at a location above the upper edge of said hinged panel, and extends forwardly at an angle generally inverse to the angle of inclination of said hinged panel.

8. The furnace of claim 7 wherein fluid fuel is introduced into said second compartment from the rear of said furnace and is caused to burn in an elongated zone providing substantially uniform distribution of heat throughout said compartment.

9. The furnace of claim 5 wherein said diffuser is positioned between said baffles in coacting relationship to further improve the transfer of heat from the walls of said compartments to the air within said chamber.

* * * * *